US005619611A

United States Patent [19]

Löschen et al.

[11] Patent Number: 5,619,611

[45] Date of Patent: Apr. 8, 1997

[54] DEVICE FOR REMOVING DOWNHOLE DEPOSITS UTILIZING TUBULAR HOUSING AND PASSING ELECTRIC CURRENT THROUGH FLUID HEATING MEDIUM CONTAINED THEREIN

[75] Inventors: Carsten Löschen, Bonn; Alexander Thiel, Speyer, both of Germany

[73] Assignee: TuB Tauch-und Baggertechnik GmbH, Cologne, Germany

[21] Appl. No.: 570,942

[22] Filed: Dec. 12, 1995

[51] Int. Cl.[6] ..... E21B 43/24

[52] U.S. Cl. ..... 392/324; 392/311; 392/302; 166/60

[58] Field of Search ..... 392/324, 325, 392/322, 338, 311, 312, 302, 303, 305, 301; 166/302, 60

[56] References Cited

U.S. PATENT DOCUMENTS

| | | | |
|---|---|---|---|
| 522,737 | 7/1894 | Lucock | 392/303 |
| 556,524 | 3/1896 | Williamson et al. | 392/301 |
| 884,424 | 4/1908 | Seymour et al. | 392/324 |
| 5,142,608 | 8/1992 | Meshekow | 392/303 |

FOREIGN PATENT DOCUMENTS

| | | | |
|---|---|---|---|
| 576393 | 10/1977 | U.S.S.R. | 166/60 |
| 1105604 | 7/1984 | U.S.S.R. | 166/60 |
| 1114782 | 9/1984 | U.S.S.R. . | |
| 1333992 | 8/1987 | U.S.S.R. | 392/311 |
| 1539310 | 1/1990 | U.S.S.R. | 166/60 |
| 1601357 | 10/1990 | U.S.S.R. | 166/60 |
| 1613588 | 12/1990 | U.S.S.R. | 166/60 |

*Primary Examiner*—John A. Jeffery
*Attorney, Agent, or Firm*—Antonelli, Terry, Stout & Kraus, LLP

[57] ABSTRACT

A device for removing deposits such as asphalt, hydrates, and paraffins from petroleum and natural gas production strings and pipelines include a tubular housing divided into a heating section at a forward end and a ballast section at a rear end, the heating section containing an electrically conducting heating medium and an electrode, and the part of the housing forming the heating section is made of an electrically conducting material, the electrode being connected to one pole of an electrical power supply and the part of the housing forming the heating section being connected to another pole of the electrical power supply, so that the heating medium and the heating section are heated by the power supply.

12 Claims, 4 Drawing Sheets

DEVICE FOR REMOVING DOWNHOLE DEPOSITS UTILIZING TUBULAR HOUSING AND PASSING ELECTRIC CURRENT THROUGH FLUID HEATING MEDIUM CONTAINED THEREIN

FIELD OF INVENTION

This invention relates to a device and method for removing deposits such as asphalt, hydrates, and paraffins from petroleum and natural gas production strings and pipelines.

1. Background of the Invention

Deposits of asphalt, hydrates, and paraffins in production strings and pipelines represent a major process problem for the oil industry. Because the production strings and pipelines are inaccessible from the surrounding formation, it is difficult to remove these deposits So that increasingly time-consuming and expensive methods must be used to remove the deposits.

2. Summary of Invention

Accordingly, a goal of the present invention is to provide a device and method for removing such deposits in a simple fashion, with the device being able to work automatically, even at great depths, in such a petroleum or natural gas production string or the like. Another goal of the invention is to design the device and the method such that the deposits are removed with simple means and hence inexpensively and at a high rate in order to keep downtimes in the oil transport system which are adversely affected by the deposits, as short as possible.

These goals are achieved by a device and method according to the invention, wherein the device is provided with a heating section and a ballast section separated from each other by an intermediate section which is thermally insulated from the heating section.

According to the invention, it is proposed that a device for removing deposits such as asphalt, hydrates, and paraffins from petroleum and natural gas production strings and pipelines comprises a tubular housing divided into a heating section with a front end area or zone in the operation direction and a ballast section located behind the heating section, the heating section containing an electrically conducting heating medium and an electrode, the housing surrounding or forming the heating section being made of an electrically conducting material and electrode being arranged to be connected to one pole of one polarity of an electrical power supply and the housing surrounding heating section being arranged to be connected to another pole of opposite polarity of the electrical power supply.

The method according to the invention is based on melting away the deposits in the petroleum and natural gas production strings and pipelines with the aid of the device of the invention wherein a housing zone of the tubular device located at the end in the forward direction of the device is heated. This housing end is heated by direct resistance heating, in which the heating medium in this housing end is heated to a temperature sufficient to evaporate the heating medium by means of an electrode and a voltage applied thereto and the housing designed to be electrically conducting, serves as an opposite pole, Whereby the housing is heated in this end zone to the degree that the deposits coming in contact with it can be melted away. The medium evaporated due to the resistance heating in the tubular housing then rises in the housing and is cooled and condensed on the unheated areas of the housing walls and runs back down the walls to the zone at the end, when it is once again evaporated by the heating of the electrode located therein. During operation, the electrode and the housing wall of the heating section are continuously energized.

In a particularly advantageous embodiment of the invention, it is proposed that an intermediate section be formed between the heating section and the ballast section to seal these two sections off from each other in a heat-insulating manner. This intermediate section Separates off the heatable heating section that heats up during operation from the ballast section, so that heat transfer is prevented and the device can be handled at the ballast section without risk of burning, for example, when it is removed from a pipe after the cleaning process.

The ballast section confers a sufficiently high weight on the device according to the invention that it can work automatically at great depths in a production string by gravity.

The invention proposes providing a heating medium With a sufficiently high specific electrical resistance which is heatable once the voltage is applied to the electrode in the manner of direct resistance heating up to evaporation of the heating medium, whereby the housing in the heating section, particularly at the end, is heated to a temperature sufficient to melt away the deposits. This heating medium, which usually is a fluid, can be, for example, an aqueous solution of a natural salt mix such as Carlsbad salt, etc., in distilled water which is provided with high-melting point and finely divided metals such as titanium and/or tungsten. $Na_2SO_4$ or $Na_2CO_3$ salt solutions are also useful as the aqueous solution. The heating medium preferably has an electrical resistance of 35 to 45 ohms.

According to the invention, it is particularly advantageous for the heating medium to be provided within the end zone of the heating section and for the remaining inside zone of the heating section to collect the evaporated heating medium. To produce a sufficient internal area for collecting the evaporated heating medium, the invention also proposes that the heating medium take up approximately 2 to 10 vol. % of the total internal volume of the heating section. A sufficient heating of the device according to the invention is achieved if a fluid quantity of 10 to 50 g distilled water, containing 15 to 30 mg natural salt and 0.01 g each titanium and tungsten is used as a heating medium, so that the heating medium has a resistance of 35 to 45 ohms, to achieve a working temperature of 150° to 350° C. in the front end gone of the device with an applied voltage of 200 to 800 V.

For the electrical connection from the power supply to the device according to the invention, an electrically insulated multiwire cable connection is provided in the ballast section, into which cable connection an electric cable connectable to the power supply and extendable from the ballast section at its free end can be plugged.

In a further advantageous embodiment of the invention, the electrode has a rod shape and is attached to the heat-insulating section Located between the heating and ballast section and Connected to the cable connection located in the ballast section.

It is also provided that the rod-shaped electrode extends up a point close to the interior of the end of the heating section and is guided inside the heating section by means of an electrically insulating spacer, whereby the electrode tip dips into the heating medium in the operating state.

According to the invention, it is possible to manufacture the device for removing deposits with the dimensions necessary for the current parameters of the petroleum and natural gas production strings and/or pipelines to be cleaned.

Suitable dimensions for the device according to the invention comprise a tubular housing with an outside diameter of 20 to 40 mm, a total length of 800 to 1500 mm, a power supply of 200 to 800 V, and a starting current of approximately 15 A. Such a device is heated in the end zone of the housing to 150° to 350° C., a temperature sufficient to melt away deposits in petroleum and natural gas production strings. The device can be inserted down to 7,000 m and even lower in production strings. Depending on the volume of the deposits to be melted away, the device has an operating rate, i.e. penetration rate, of 5 to 20 m/h.

BRIEF DESCRIPTION OF THE DRAWINGS

The invention will now be described in greater detail with reference to one embodiments of the device shown in the accompanying drawings, wherein.

DETAILED DESCRIPTION OF THE INVENTION

Figure 1:
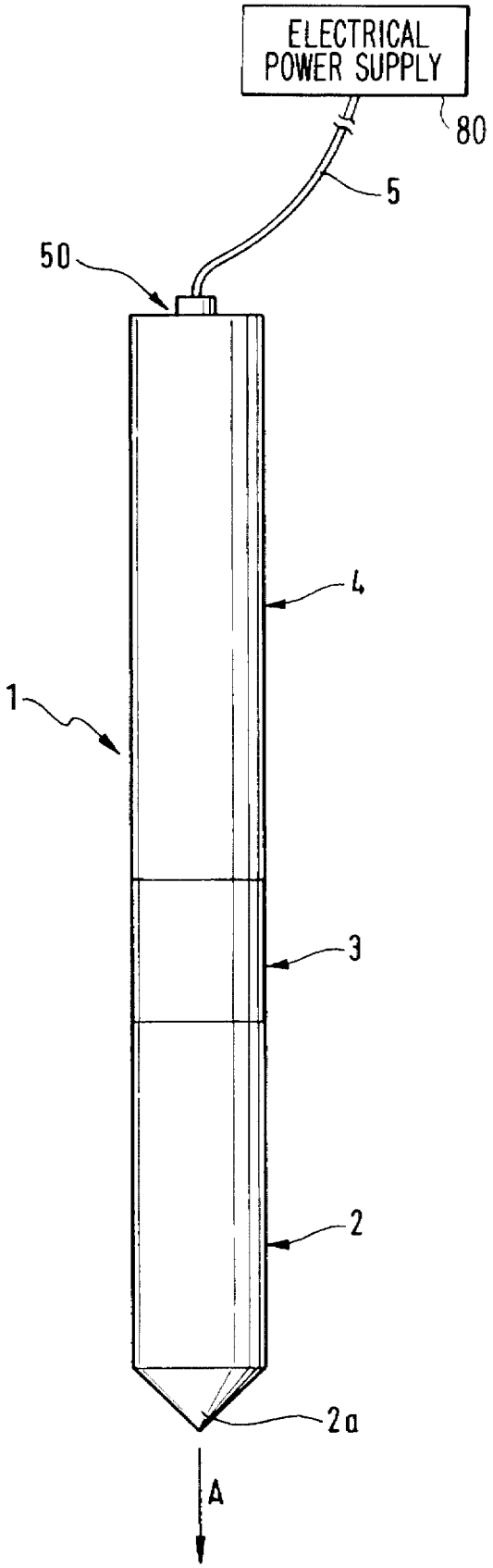
FIG. 1 is a schematic view of the device according to the invention for removing deposits.
Figure 2:
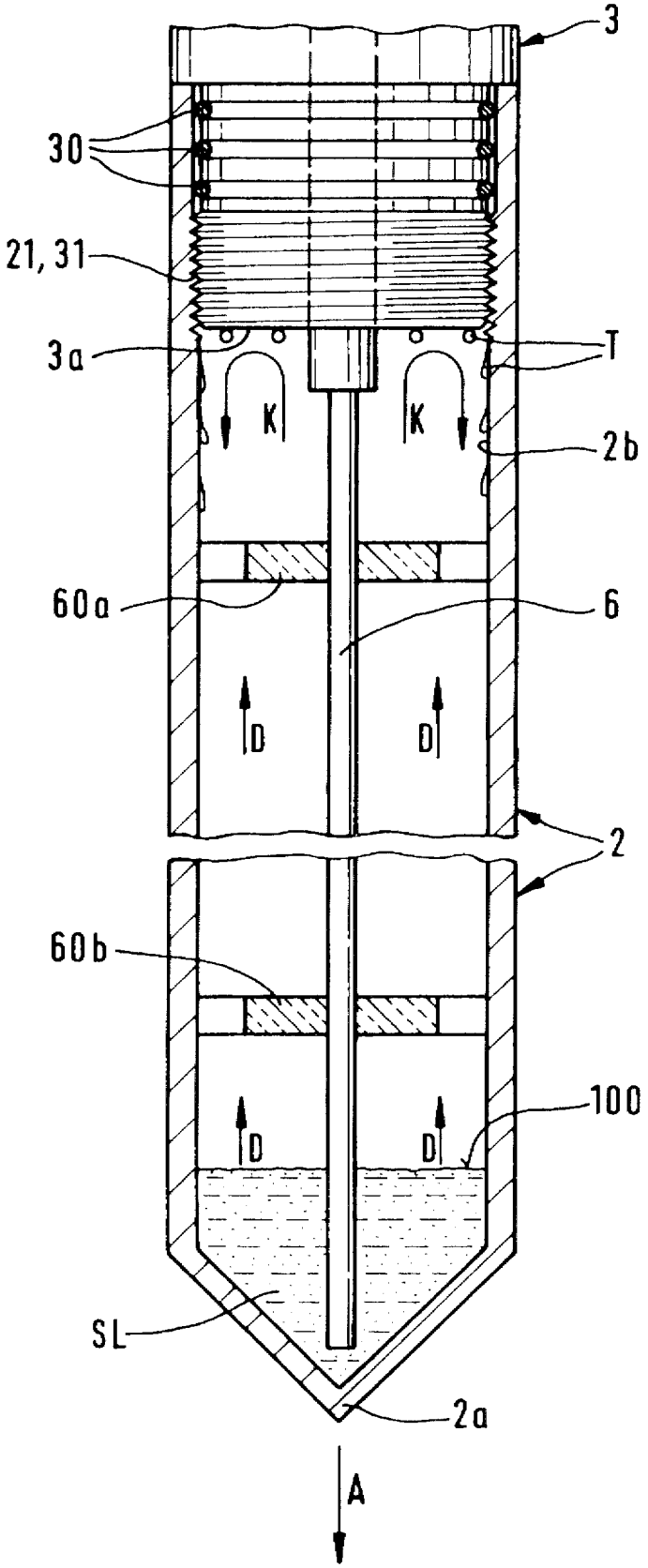
FIG. 2 is a lengthwise partial section through one end of the device according to the invention as shown in FIG. 1 on an enlarged scale.
Figure 3:
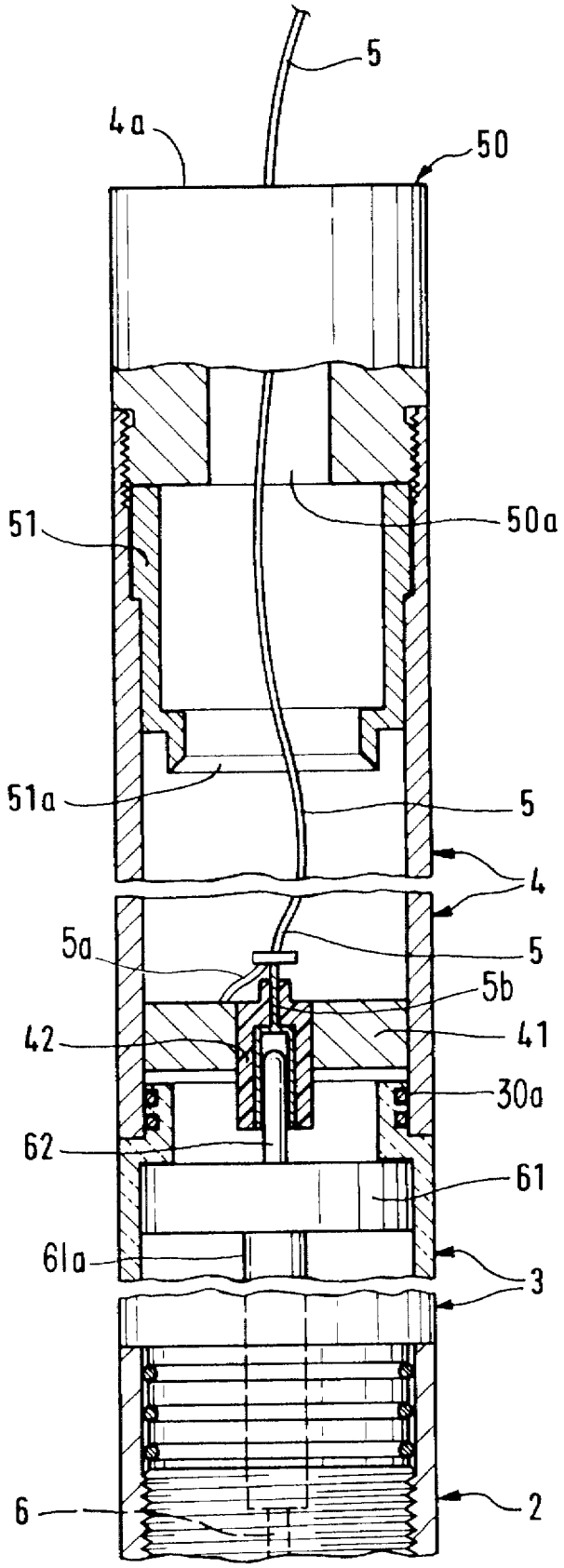
FIG. 3 is a lengthwise partial section through the other end of the device according to the invention shown in FIG. 1 on an enlarged scale.

According to FIG. 1–3, the device 1 according to the invention comprises a tubular housing 40, divided into a housing part forming a heating section 2 and a housing part forming a ballast section 4, with the heating section 2 and ballast section 4 being separated by a section 3 which seals sections 2, 4 off from one another and insulates sections 2, 4 thermally by means of gaskets 30, 30*a*. In operating direction A, the heating section 2 is closed off at one end of the device by an outward-pointing tip 2*a*. At the opposite end 50 of the device, i.e. at the ballast section 4, a cable 5 for electrical connection of device 1 to a power supply 80, not shown here in detail, extends out of the housing which is closed, as will be described hereinafter.

In order to heat heating section 2, particularly at its tip 2*a*, the device according to the invention, as shown in FIG. 2, has rod-shaped electrode 6, the electrode is positioned along a longitudinal axis within the heating section 2. This rod-shaped electrode 6 is provided at its upper end with a flange ring 61 made of electrically insulating material and being attached thereby to section 3 connected to heating section 2, sealing off the latter by means of gaskets 30 which are made of a heat-insulating and resilient sealing material, e.g. PVC. Section 3 is connected by threaded portion 31 into threads 21 of the housing part forming the heating section. The electrode 6 is electrically insulated from the walls of the sealing section by means of insulating cover 61*a* made of electrically insulating material like a ceramic. As can be seen from FIG. 3, rod-shaped electrode 6 is connected to the electrical power supply by a cable 5 which passes through a through-hole 50*a*. Electrical cable 5 is connected inside ballast section 4 with a female connector 42 secured by a ring 41, into which connector 42*a* connecting pin 62, located at the upper end of electrode 6 and guided in heat-insulated section 3, can be plugged so that electrode 6 can be connected by a plug-in connection 42, 62 to the power supply. For power supply of alternate current to the device, usually an insulated multiwire cable 5 is used.

Intermediate section 3, which is also made of metal like high grade steel, is connected in a sealing fashion in a manner not shown in detail with ballast section 4 and ballast section 4 is closed off end-wise by means of end cap 50 and a sealing sleeve 51.

The connections of the various sections and of the heat-insulating section are not confined to the embodiment shown here, but the invention can be implemented with all suitable and normal connections.

According to FIG. 2, electrode 6 connected in this manner to the power supply is glided inside heating section 2 by means of electrically insulating disks 60*a*, *b* and dips with its end zone pointing in operating direction A into a salt solution SL made of distilled water and Carlsbad salt with small amounts of finely-divided titanium and tungsten, which solution is added in the vicinity of tip 2*a* of heating section 2, The level 100 of salt solution SL is chosen such that sufficient space which heating section remains above salt solution EL. The housing part of heating section 2 is made of an electrically conducting material such as a special steel and is connected, by means of the ring 41 or directly to housing 4 to the electrical power supply with cable wire 5*a* with a different pole from that of rod-shaped electrode 6 which is connected to the other pole by means of the cabs wire 5*b*, and thus forms the counter-electrode to rod-shaped electrode 6. The housing of ballast section 4 is also made of high grade steel.

If a sufficiently high voltage, which is, for example, in the range between 200 and 900 volts, and which depends on the dimensions of the device according to the invention, and varies according to the depth of the deposits and the operating depth, is applied to rod-shaped electrode 6, the salt solution heats up in a manner known to itself by the principle of direct resistance heating. That is the salt solution forms a conducting resistance between electrode 6 and the housing part of heating section 2 which functions as a counter-electrode. By this heating of the salt solution, the housing part of heating section 2 that surrounds the salt solution also necessarily heats up, primarily in the area filled with salt solution SL. In this manner, according to the invention, local heating of the device at its end is achieved, which makes it possible for the deposits such as asphalt, hydrates, and paraffins to be removed, i.e. to be melted away.

Heating of salt solution SL by electrode 6 takes place at a temperature such that salt solution SL begins to evaporate. The vapor D from salt solution SL rises from level 100 of salt solution SL and arrives at the upper area of heating section 2, which is sealed in a gas-tight manner from heat-insulating section 3 by means of gaskets 30. Particularly, the upper areas 2*b* of the inner walls of heating section 2 and end face 3*a* of section 3 have a considerably lower temperature than that of the end area 2*a* of heating section 2, heated by the salt solution, which results in the vapor D rising from the salt solution forming drops T on end fate 3*a* of heat-insulating section 3 and condensing on side walls 2*b* of heating section 2 and running down side walls 2*a* back to level 100 of salt solution SL in the direction of arrows K.

The invention now provides that by the heating medium in the form of salt solution SL being only in a small amount to the total volume of the space inside heating section 2, not only local heating of heating section 2 occurs at its end area 2*a*, but also the temperature is reliably and automatically regulated. Heating of the salt solution is not unlimited, because as a result of evaporation, level 100 of the salt solution drops continuously, until in the extreme case no salt solution is left at the electrode and accordingly no further heating takes place. In this way, a maximum temperature of tip 2*a* of heating section 2 can be defined by the quantity of salt solution, and further heating of tip 2*a* occurs only when sufficient vapor D from salt solution SL condenses as drops T and flows back into the area of the electrode to form a new level 100 of salt solution SL.

Figure 4:
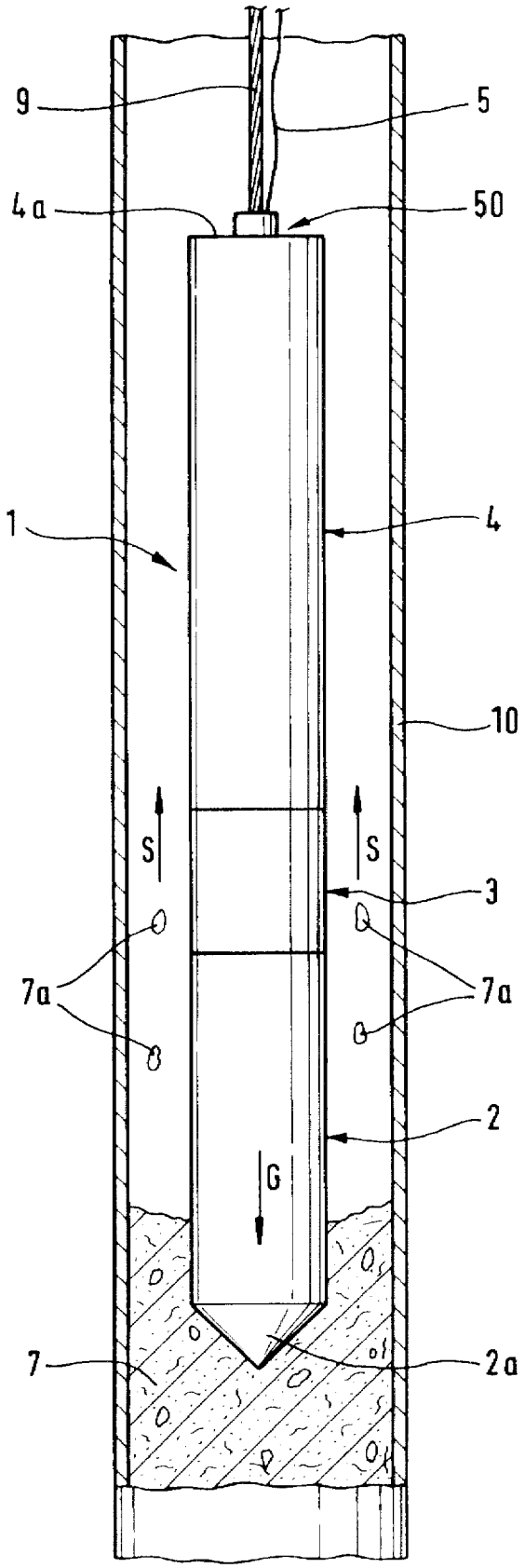
FIG. 4 shows schematically the use of the device according to the invention for removing deposits in a petroleum production string.

According to FIG. 4, it is thus possible in a simple manner to remove deposit 7 in a production string 10, for example, by melting the deposit away. For thus purpose, device 1 according to the invention is suspended from a cable 9 and lowered down tube 10 to be cleaned, by gravity G. An electrical voltage is applied to the electrode through wire 5*b* of cable 5 and to the housing walls via wire 5*a* so that the projecting tip 2*a* of heating section 2 heats up to a temperature sufficient to melt away deposit 7. When a sufficient weight is provided in ballast section 4, device 1 according to the invention can more easily penetrate with its outwardly projecting tip 2*a* of its heating section 2 automatically into deposit 7, whereby deposit 7 is melted away. Small parts 7*a* of deposit 7 are thereby swept upward by oil stream S while large pieces of deposit settle, once the device according to the invention has passed through, on the flat top side 4*a* of ballast section 4 and when device 1 according to the invention is pulled up by cable 9, come up with it and can be removed once the device according to the invention has been taken out of production string 10. This cleaning process is then repeated until all of the deposit 7 have been removed from production string 10.

In this way, it is possible to rid nearly all petroleum and natural gas production strings and pipelines of deposits such as asphalt, hydrates, and paraffins with the device according to the invention. Also, the device according to the invention can be left alone while it is operating, since it descends by gravity to great depths, for example in oil wells, in addition to which the temperature at the tip in the operating direction is regulated by the quantity of salt solution in it automatically, reliably, free of any control elements, and thus in a manner insensitive to outside influences.

For maintenance and cleaning of the device and renewal of the heating fluid, parts of the device, particularly the heating section, can be removed from the other parts.

What is claimed is:

1. A device for removing deposits such as asphalt, hydrates, and paraffins from petroleum and natural gas production strings and pipelines which comprises a tubular housing that is adapted to fit within the production string and that is divided into a heating section with a front end zone arranged in an operating direction and a ballast section at a rear end, said heating section containing an electrically conducting heating medium and an electrode, a part of the housing forming the heating section being made of an electrically conducting material, and the electrode being connected to one pole of an electrical power supply, and the part of the housing forming said heating section being connected to another pole of the electrical power supply so that the heating section is heated by the electrical power supply; the electrode extending up to a point close to the interior of the front end zone of the heating section and being guided inside said heating section by means of electrically insulating spacers, whereby the electrode tip dips into the heating medium in the operating state and the heating medium being an aqueous solution of a salt mix in distilled water to which high-melting point finely divided metals including at least one of titanium and tungsten are added.

2. A device according to claim 1, wherein between the heating section and the ballast section an intermediate section that seals the two sections off from each other is provided.

3. A device according to claim 1, wherein the heating medium is provided inside the front end zone of the heating section and a remaining internal zone of the heating section serves to receive evaporated heating medium.

4. A device according to claim 1, wherein the heating medium has an electrical resistance of 35 to 45 ohms.

5. A device according to claim 1, wherein a cable connection is located in the ballast section into which cable connection a cable connectable to the power supply and extendable from the ballast section at its free end can be inserted.

6. A device according to claim 5, wherein the cable connection comprises a plug-in connection.

7. A device according to claim 1, wherein the electrode has a portion that is rod-shaped and can be attached to a heat-insulating section located between the heating section and the ballast section and is adapted to be connected to a cable connection located in the ballast section.

8. A device according to claim 1, wherein the front end zone of the heating section is provided with an outward-pointing tip.

9. A device according to claim 1, wherein the tubular housing has a cylindrical cross section and a length of approximately 1.5 to 3 meters.

10. A device according to claim 1, wherein at least a part of the tubular housing is made from a metal.

11. A device according to claim 1, wherein the electrode is connected to a power supply of 200 to 900 volts.

12. A device according to claim 1, wherein the heating section is adapted to be heated to temperatures of 150° to 350° C.

* * * * *